US005184498A

United States Patent [19]

Hayashi

[11] Patent Number: 5,184,498

[45] Date of Patent: Feb. 9, 1993

[54] TURRET PUNCH PRESS

[75] Inventor: Tetsuji Hayashi, La Mirada, Calif.

[73] Assignees: Amada Mfg. America, Inc., La Mirada, Calif.; Amada Company, Ltd., Kanagawa, Japan

[21] Appl. No.: 838,867

[22] Filed: Feb. 21, 1992

[51] Int. Cl.[5] ..... B26F 1/04; B26D 5/08

[52] U.S. Cl. ..... 72/442; 72/453.03; 83/552

[58] Field of Search ..... 72/441, 442, 453.03; 83/549, 552

[56] References Cited

U.S. PATENT DOCUMENTS

| | | | |
|---|---|---|---|
| 3,143,007 | 8/1964 | Thompson | 72/453.03 |
| 3,685,380 | 8/1972 | Daniels | 83/552 |
| 3,783,672 | 1/1974 | Morgolenko et al. | 72/453.03 |
| 4,250,785 | 2/1981 | Morishita et al. | 83/552 |

FOREIGN PATENT DOCUMENTS

| | | | |
|---|---|---|---|
| 2600948 | 7/1977 | Fed. Rep. of Germany | 72/453.03 |
| 173000 | 11/1987 | Japan . | |
| 0013236 | 1/1991 | Japan | 83/552 |

*Primary Examiner*—David Jones

*Attorney, Agent, or Firm*—Wigman & Cohen

[57] ABSTRACT

A turret punch press wherein the upper and lower turrets are rotated, and the upper die positioned in the processing position is struck by a piston rod (striker element) of a striker device mounted on the lower end of a ram when the ram is lowered by means of a crank shaft (mechanical vertically moving means). The piston rod can be freely moved vertically by a hydraulic cylinder so that the amount of the stroke of the striker element with respect to the upper die is the sum of the amount of the stroke of the ram and the amount of the stroke of the piston rod in the hydraulic cylinder itself. Accordingly, the upper die and the lower die come into contact and the processing occurs only when the ram and the piston rod are both at bottom dead center.

3 Claims, 9 Drawing Sheets

TURRET PUNCH PRESS

BACKGROUND OF THE INVENTION

1. Field of the Invention

The present invention relates to a turret punch press, and, in particular, to a mechanical turret punch press in which an upper tool is actuated jointly by both a mechanical striker and a hydraulic striker.

2. Description of the Prior Art

Conventionally, a commonly known turret punch press comprises a freely rotatable upper turret equipped with a plurality of freely detachable upper tools, a freely rotatable lower turret in opposition to the upper turret, and a freely vertically mobile striker which strikes the upper tool in the processing position. A disk support which supports the lower turret is provided on the lower side of the lower turret in the processing position for resisting the impact from a striking element.

During a forming process, the upper turret and the lower turret are rotated in sychronism and a pair of dies for specific forming is positioned in the processing position, a workpiece is positioned between the two dies, and the forming process is performed by pressing the upper and lower dies together using a mechanical or a hydraulic device.

However, in the above-mentioned mechanical type of punch press, because the forming die is not formed with a through hole, a forming punch (the upper die) which is suddenly dropped, impacts a forming die (the lower die) and an excess force acts on the die, or a die holder, or on the lower turret, or the like, so that there is concern about damage or breakage. For this reason, a difficult height adjustment must be scrupulously performed from time to time to change the height of the die.

In the case of a punch press using a hydraulic device, it is possible to prevent any excess force from acting on the die or the die holder, or on the lower turret, or the like, but frequent use of the hydraulic device shortens the life span of a large number of parts. In addition, the hydraulic device is expensive which is a disadvantage from the aspect of operating costs.

SUMMARY OF THE INVENTION

An object of the present invention is to provide, with due consideration to the drawbacks of such conventional devices, a turret punch press wherein, even when the height of the die is not adjusted with scrupulous care, there is no damage to the die or the turret.

This object is achieved in the present invention by the provision of a turret punch press comprising an upper turret on which an upper die is detachably mounted; a lower turret on which a lower die is detachable mounted provided in mutual opposition to the upper turret; a ram for causing the upper and lower dies to work together at an operating position; a mechanical type of vertically moving means for moving the ram vertically; a striker device provided on the lower end of the ram for striking the upper die; a striking element within the striker device; and a hydraulic cylinder for moving the striking element vertically in the striker device.

This object is further achieved in the present invention by the provision of a turret punch press further comprising a disk support for supporting the lower turret in the processing position; a freely movable slider provided in the disk support; a hydraulic cylinder for pushing up the upward-forming lower die positioned in the operating position and normally below a passline; and a residue hole into which the residue from the punching operation drops, selectively positioned in the processing position; wherein the upper dies comprise an upper die for punching and an upper die for upward forming; and the lower dies comprise a lower die for punching and a lower die for upward forming. In the turret punch press of the present invention, the upper and lower turrets are rotated, and an upper die of a plurality of dies, positioned in the processing position, is struck by a striker element of a striker device mounted on the lower end of a ram when the ram descends. A hydraulic cylinder which vertically moves the striker element with respect to the ram is mounted on the striker device, and the amount of stroke of the striker element with respect to the upper die is the sum of the amount of stroke of the ram and the amount of stroke of the striker element itself, moved vertically by the hydraulic cylinder. Accordingly, the upper dies and the lower dies come into contact and the processing occurs only when the ram and the piston rod are both at bottom dead center.

During a punching process, the striker element of the striker device is normally positioned at bottom dead center, the ram is lowered by the mechanical vertically moving means, and the punching operation is effectively performed. In addition, during a forming process, the striker element of the striker device is raised with respect to the ram, and after the ram is lowered by the mechanical vertically moving means, the striker element is lowered by the hydraulic cylinder and the forming operation is effectively performed.

In addition, a freely movable slider is provided in the disk support which supports the lower turret, and a hydraulic cylinder, which pushes up an upward-forming lower die, and a residue receiving hole into which the residue from the punching operation drops are selectively provided in this slider. Accordingly, the slider is moved and the hydraulic cylinder or the residue receiving hole is selectively positioned at the processing position to cope with an upward-forming operation or a punching operation, and the processing is carried out.

BRIEF DESCRIPTION OF THE DRAWINGS

These and other objects, features, and advantages of the present invention will become more apparent from the following description of the preferred embodiment taken in conjunction with the accompanying drawings, in which.

DETAILED DESCRIPTION OF THE PREFERRED EMBODIMENTS

Other features of this invention will become apparent in the course of the following description of exemplary embodiments which are given for illustration of the invention and are not intended to be limiting thereof.

Figure 11:
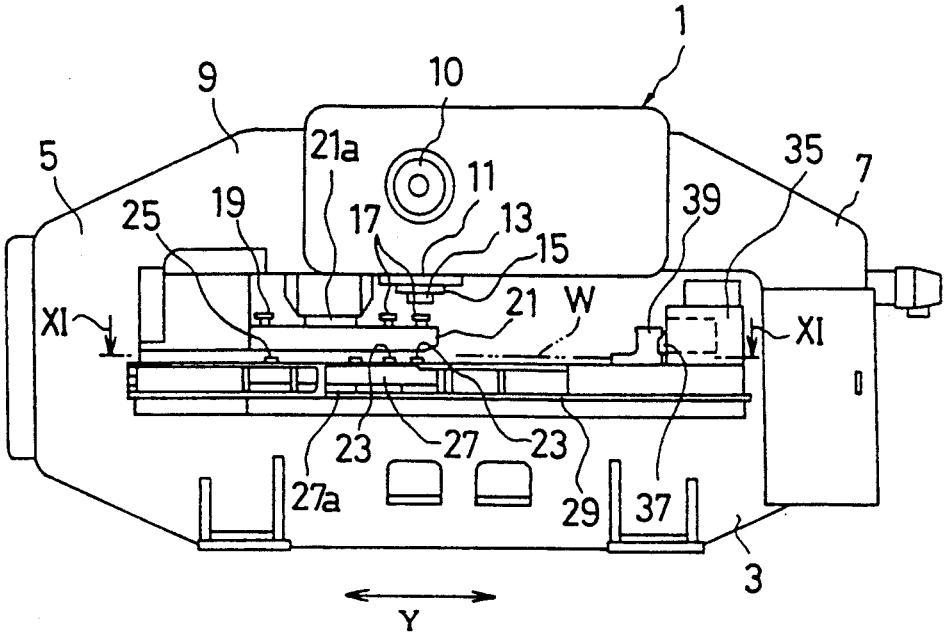
FIG. 11 is an elevation showing the entire turret punch press.
Figure 12:
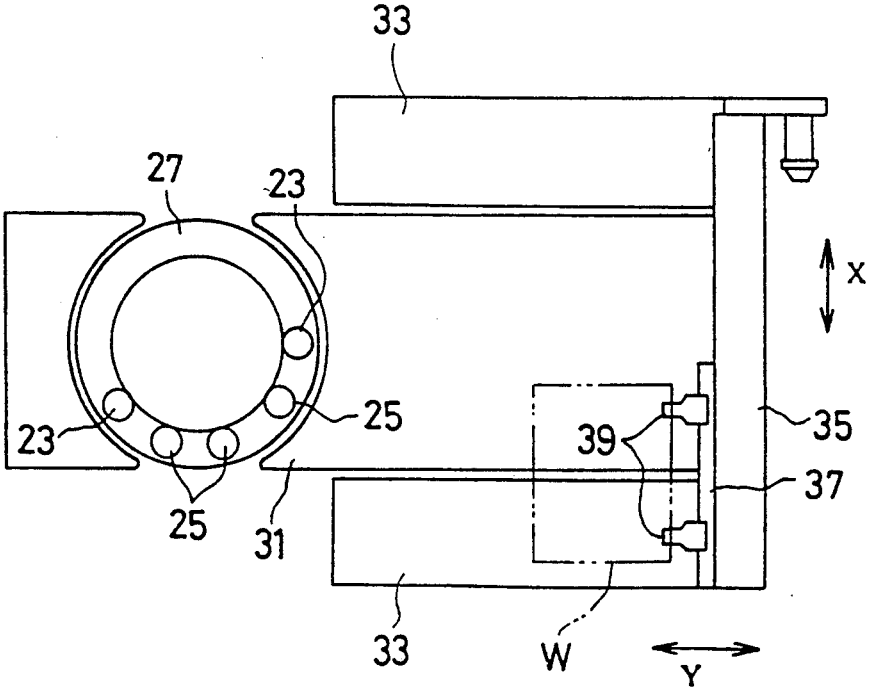
FIG. 12 is a sectional view taken along the line XI—XI in FIG. 11.

As shown in FIG. 11 and FIG. 12, a side frame 5 and a side frame 7 are erected, one on each side, of a base 3 of a turret punch press 1, and an upper frame 9 is provided on the upper side of the side frame 5 and the side frame 7. A vertically movable ram 11 mounted on the upper frame 9 is moved by a mechanical vertically moving means, which is a crank shaft 10. On the lower end of the ram 11, a striker device 15 having a piston rod 13 is provided as a striker element, freely movable vertically by a later described hydraulic mechanism.

Figure 1:
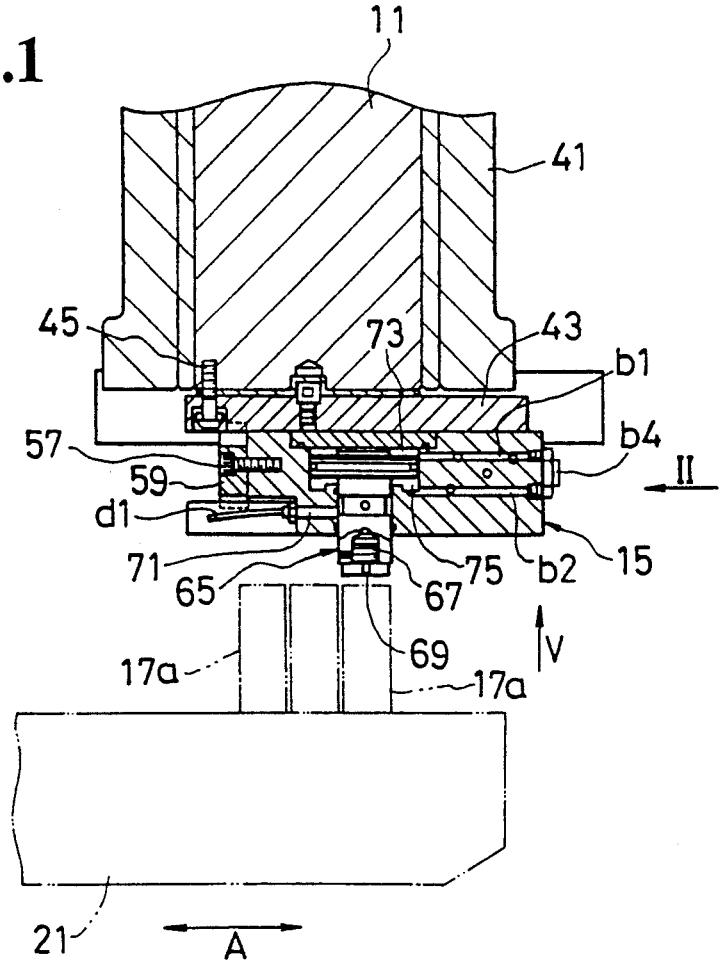
FIG. 1 is a sectional view of the main parts of a turret punch press of the present invention taken along the line I—I in FIG. 2.

In addition, on the lower surface of the upper frame 9, a disk-shaped upper turret 21, on which are detachably mounted a plurality of upper punching dies 17 and a plurality of upward-forming upper dies 19 as the upper dies, is rotatably supported by an upper rotary shaft 21*a*. In FIG. 1 a location is shown at which a die is mounted on which, in place of the normal upper dies 17, for example, a plurality of punching upper dies 17*a* is mounted in the radial direction of the upper turret 21 (the A direction in the drawing). Although not shown in the drawing, a plurality of upward-forming upper dies can also be mounted in the radial direction of the upper turret 21 (the A direction in the drawing) in place of the normal upper dies 19, in exactly the same manner. The dies 17*a* are vertically movable in the same manner as the normal upper dies 17. The dies 17*a* are to be positioned in the operating position of the ram 11.

Again referring to FIG. 11 and FIG. 12, a lower turret 27, on which are detachably mounted a plurality of lower punching dies 23 and lower upward-forming dies 25 respectively as the lower dies opposing the upper punching dies 17 and the upper upward-forming dies 19, is rotatably supported by a lower rotary shaft 27*a* on the upper surface of the base 3 opposing the upper turret 21. Although not shown on the drawings, a plurality of upper dies 17*a* are provided in the radial direction of the upper turret 21. Corresponding to the upper dies 17*a*, a plurality of lower dies (not shown) are provided on the lower turret 27 in the radial direction of the lower turret 27.

The upper turret 21 and the lower turret 27 are synchronized and rotatably controlled by means of, for example, a turret servo motor (omitted from the drawings) mounted on the side frame 5. As a result, during the punching process, the desired upper punching dies 17 and the lower punching dies 23, and, in addition, during the upward forming, the upper upward-forming dies 19 and the lower upward-forming dies 25, are controllably and selectively positioned at the processing position immediately under the ram 11.

Also, on the upper surface of the base 3, a pair of guide rails 29 is positioned in the longitudinal direction along the direction of the Y-axis in the drawing. A pair of movable tables 33, positioned one on each of the front and back sides of a fixed table 31 secured on the base 3, are movably supported on the guide rails 29. The movable tables 33 are integrally mounted on a carriage base 35 extending in the X-axis direction over the fixed table 31. In addition, a carriage 37 which moves in the longitudinal direction (the X-axis direction) crossing the direction of motion of the movable table 33 (the Y-axis direction in the drawings) is mounted on the carriage base 35. A clamp 39 which clamps one end of a plate-shaped workpiece W is movably mounted in the X-axis direction on the carriage 37.

Accordingly, to position the workpiece W, the movement of the carriage 37, on which is mounted the clamp 39 which clamps one end of a plate-shaped workpiece W, is controlled in the X-axis direction on the carriage base 35, and the positioning is performed by controlling the movement of the carriage 35 in the Y-axis direction along the guide rails 29.

Figure 2:
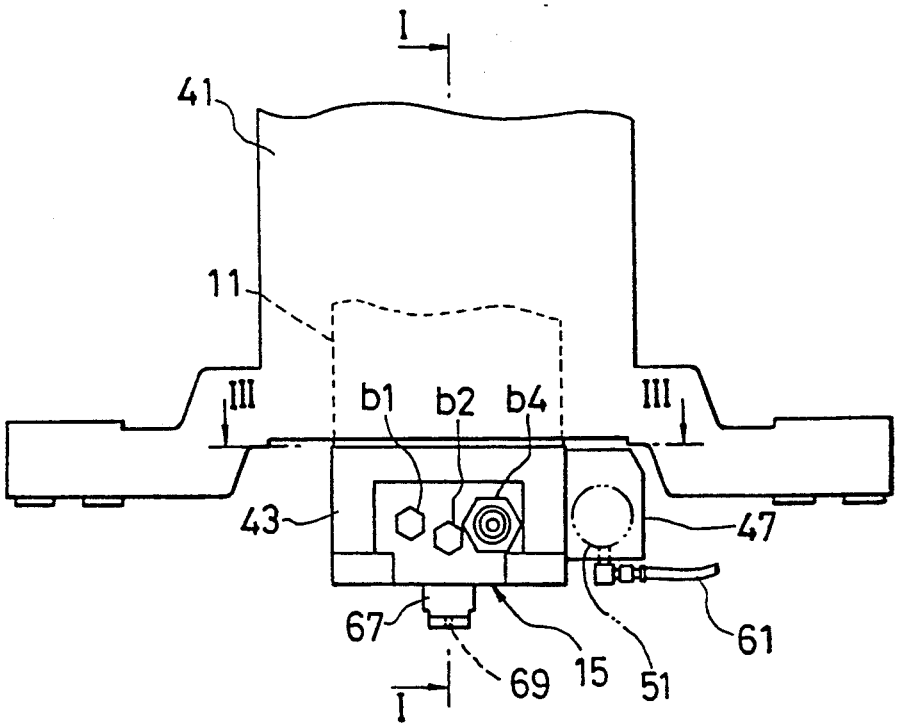
FIG. 2 is a side elevation viewed in the direction of the arrow II in FIG. 1.
Figure 3:
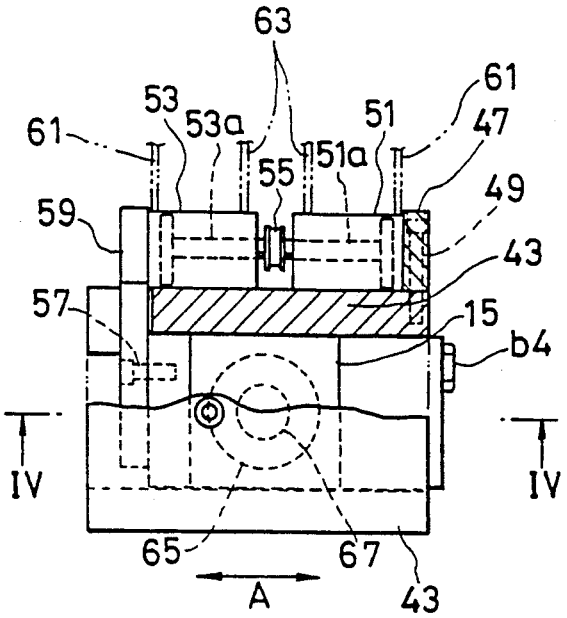
FIG. 3 is a sectional view taken along the line III—III in FIG. 2.
Figure 6:
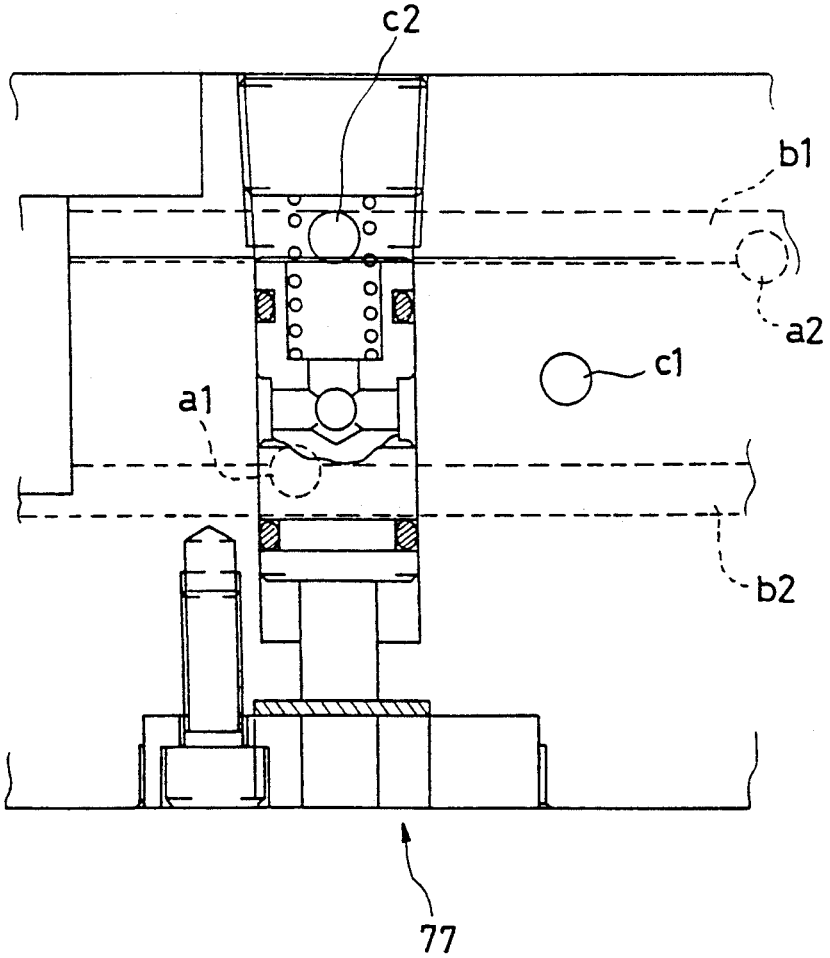
FIG. 6 is a detailed sectional view of a manual valve.

As shown in FIG. 1 to FIG. 3, a ram guide 41 is provided on the upper frame 9 for moving the ram 11 vertically. Furthermore, a channel-shaped guide 43 opening in the downward direction is installed on the bottom surface of the ram 11 by means of a bolt 45 extending in the radial direction of the upper turret 21 (the A direction in the drawings). A cylinder bracket 47 is installed by means of a bolt 49 on the right end of the guide 43 in FIG. 2. A fixed hydraulic cylinder 51 is securely installed on both the cylinder bracket 47 and the guide 43 on the right end section of the guide 43. Accordingly, the guide 43, the cylinder bracket 47, and the fixed hydraulic cylinder 51 do not move with respect to the ram 11. In addition, a movable hydraulic cylinder 53 opposing the fixed hydraulic cylinder 51 is provided in a manner allowing free movement along the guide 43. The tip of a piston rod 51*a* of the fixed hydraulic cylinder 51 and the tip of a piston rod 53*a* of the movable hydraulic cylinder 53 are linked by a joint 55. The bottom surface of the movable hydraulic cylinder 53 is secured to a connecting member 59, fastened by a bolt 57 to the left end of the striker device 15.

According, by feeding an operating fluid from a tube 61 of the fixed and movable hydraulic cylinders 51, 53 into the cylinder chamber and discharging it from a tube 63, the piston rod 51*a* of the fixed hydraulic cylinder 51 is projected to the left. To project the piston rod 53*a* of the movable hydraulic cylinder 53 to the right, the movable cylinder 53 pulls the striker device 15 to the left in FIG. 1 in the inside of the guide 43 through the connecting member 59. Conversely, the piston rod 51*a* of the fixed hydraulic cylinder 51 is moved to the right by feeding the operating fluid from the tube 63 into the cylinder chamber and discharging it from the tube 61. The movable cylinder 53 moves the striker device 15 to the right in FIG. 1, through the connecting member 59, to project the piston rod 53*a* of the movable hydraulic cylinder 53 to the left.

A hydraulic cylinder is provided in the striker device 15 as a hydraulic striker cylinder with a piston rod 67 projecting freely downward, and, as explained above, the piston rod 67 is positioned on the normal upper dies 17, 19 or at the upper part of a specific upper die 17*a* provided in the radial direction of the upper turret 21, positioned in the operating position, by moving and positioning the striker device 15. In addition, because the piston rod 67 strikes the upper surface of the upper dies 17, 17*a*, 19 while projecting downward, the stroke length for the vertical movement of the tip of the piston rod 67 when the upper dies 17, 17*a*, 19 are struck is the sum of the stroke length of the ram 11 itself, moved by the clamp shaft 10, and the stroke length of the piston rod 67 of the hydraulic striker cylinder 65.

Figure 4:
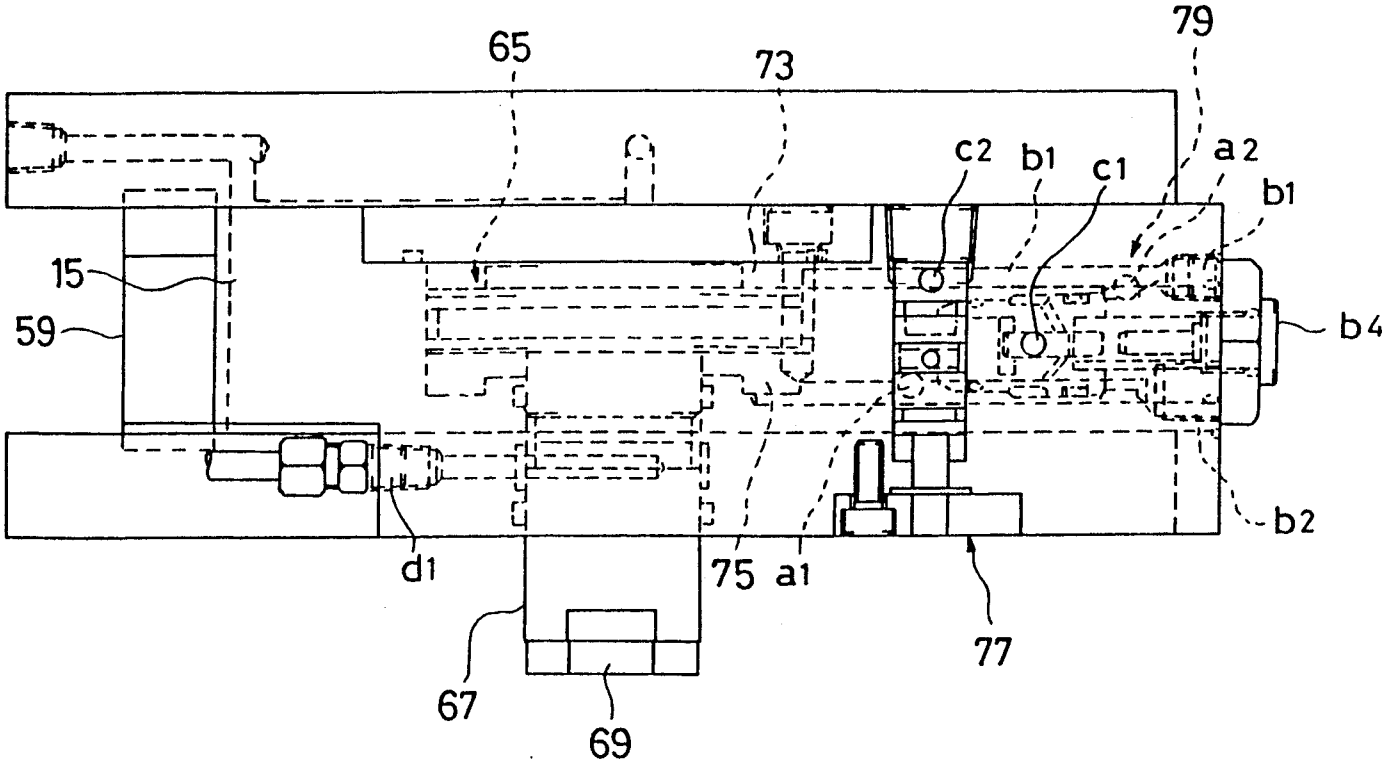
FIG. 4 is an enlarged sectional view taken along the line IV—IV in FIG. 3.
Figure 5:
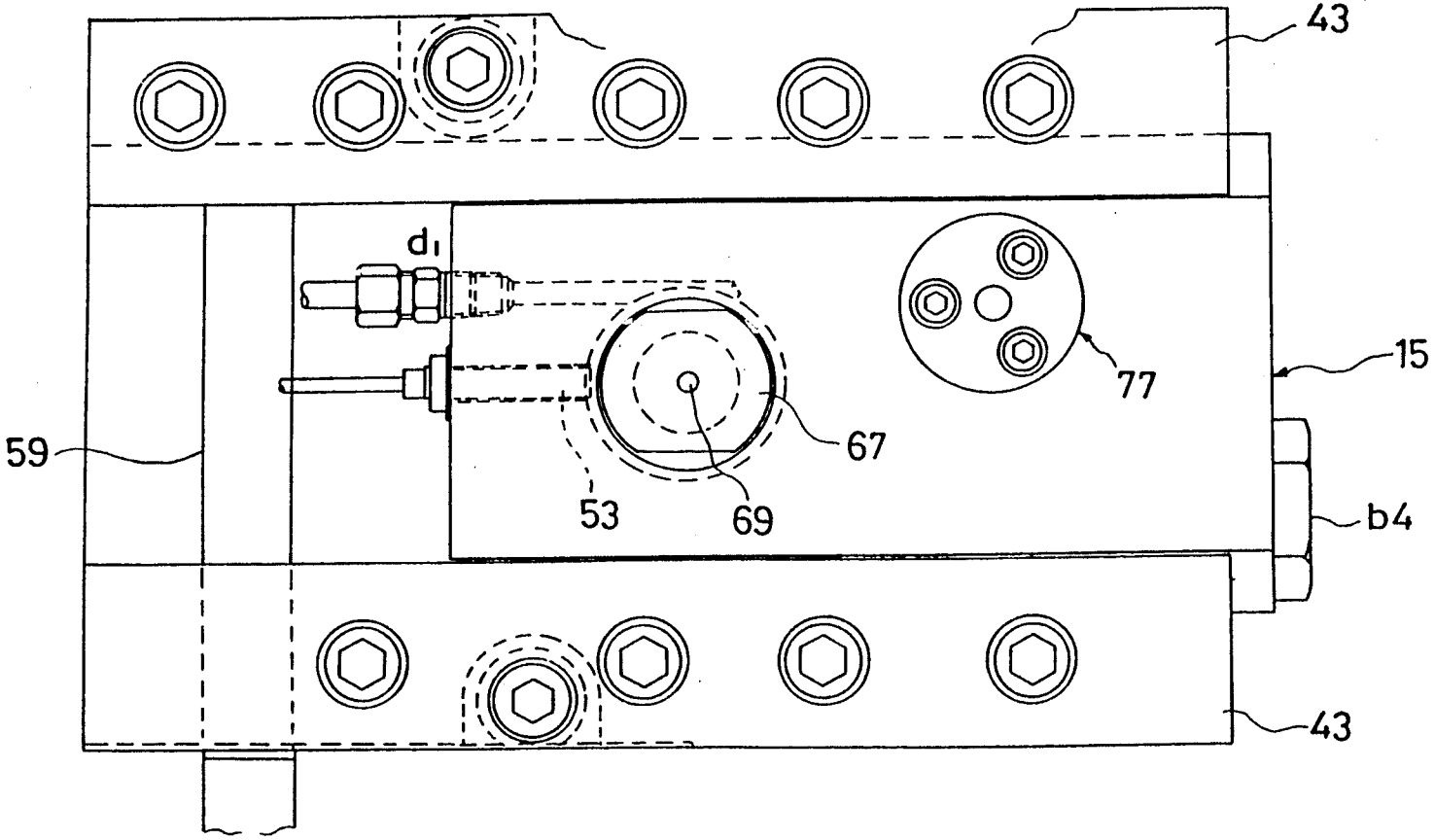
FIG. 5 is an enlarged bottom view with one part omitted, viewed in the direction of the arrow V in FIG. 1.

An air blower 69 is provided at the center of the bottom surface of the piston rod 67, and compressed air supplied from a tube d1 (see FIG. 4 and FIG. 5) is fed to the inside of the piston rod 67 from the side surface of the cylinder chamber, and, not shown in the drawings, is blown out of discharge ports in the lower surfaces of the upper dies 17, 19, so that the workpiece W is separated from the upper dies 17, 19 and the scrap is ejected from the upper dies 17, 19.

A proximity switch 71 for detecting the vertical movement of the piston rod 67 is provided on the punching device 15 in the vicinity of the piston rod 67. The switch 71 detects the vertical position of the piston rod 67, and detects whether or not the piston rod 67 has reached the top and bottom dead center in a normal manner.

Next, the hydraulic mechanism of the punching hydraulic cylinder 65 will be explained, based on FIG. 4 to FIG. 7. A tube $b_1$ is provided to feed operating fluid to an upper cylinder chamber 73 of the punching hydraulic cylinder 65 to lower the piston rod 67. One end of the tube $b_1$ passes into the upper cylinder chamber 73 and the other end reaches to the right side end surface of the striker device 15 and is closed. In addition, when the operating fluid from the tube $b_1$ is fed into the upper cylinder chamber 73, the operating fluid in a lower cylinder chamber 75 is discharged by the action of the piston rod 67, or, a tube $b_2$ is provided parallel to the tube $b_1$ to feed operating fluid to the lower cylinder chamber 75 to elevate the piston rod 67. One end of the tube $b_2$ is open to the lower cylinder chamber 75 and the other end is open to the right end surface of the striker device 15. In a location part way along the tube $b_1$ from the punching hydraulic cylinder 65, a tube $c_2$ connected to a manual valve 77 is provided, crossing the tube $b_1$. In the vicinity of the right end surface part way along the tube $b_1$, a tube $a_2$ for connecting to a switching valve 79 is provided, crossing the tube $b_1$. The switching valve 79 is for controlling the flow of the operating fluid. One end is mounted on the right end surface of the striker device 15 as a $b_4$ port. A tube $a_1$ for connecting to the switching valve 79 is provided, crossing the tube $b_2$ at a location part way along the tube $b_2$ from the punching hydraulic cylinder 65. A tube $b_3$ is coupled to a tube $c_1$ connected to the switching valve 79. One end of the tube $b_3$ opens into the right end surface of the striker device 15.

Figure 7:
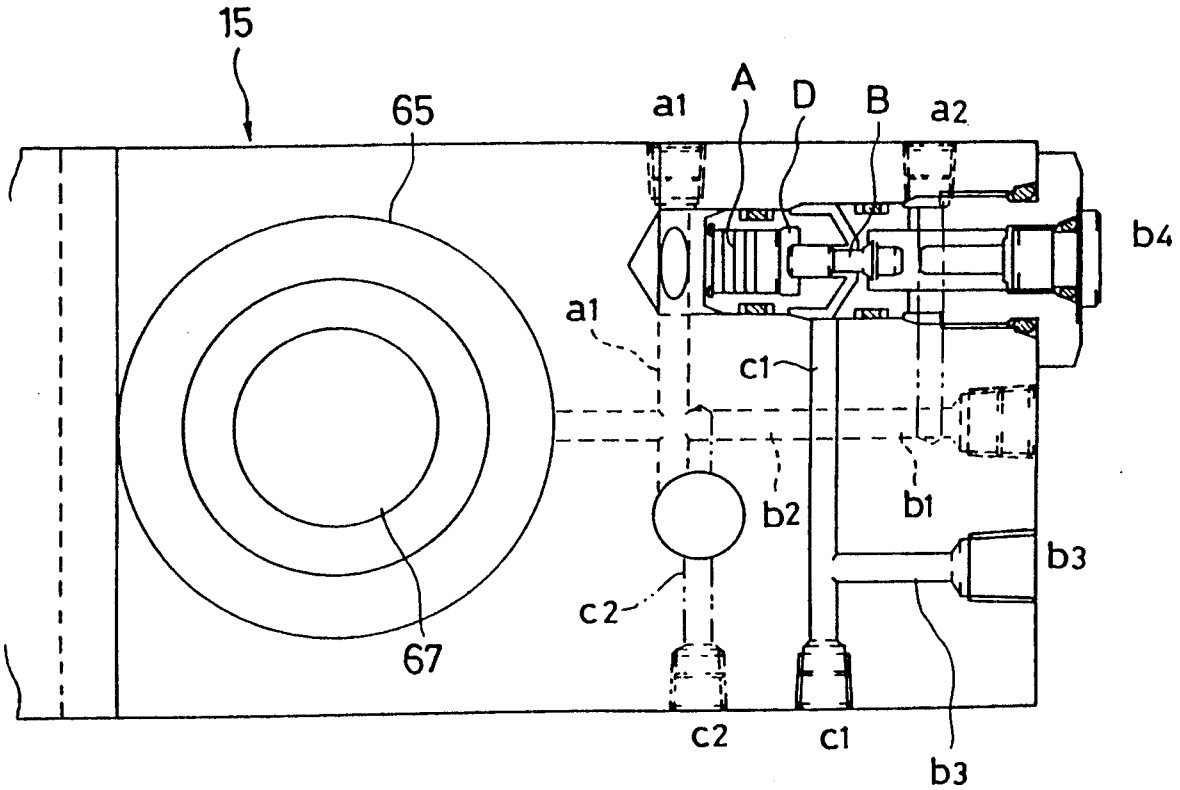
FIG. 7 is a detailed sectional view of a switching valve.

Control of the punching hydraulic cylinder 65 will now be explained with reference to the above-mentioned figures and FIG. 8. In the case where the piston rod 67 is lowered, as shown by the white arrows in FIG. 8, when operating fluid is fed from the $b_3$ port this operating fluid flows into the switching valve 79 through the tube $c_1$, and a valve B (FIG. 7) is opened to apply pressure to a chamber D (FIG. 7). As a result, the operating fluid flows from the tube $a_2$ into the tube $b_1$ and into the upper cylinder chamber 73, and the piston rod 67 is lowered. At this time, the operating fluid in the lower cylinder chamber 75 passes through the tube $b_2$ and is discharged from the $b_2$ port.

Figure 8:
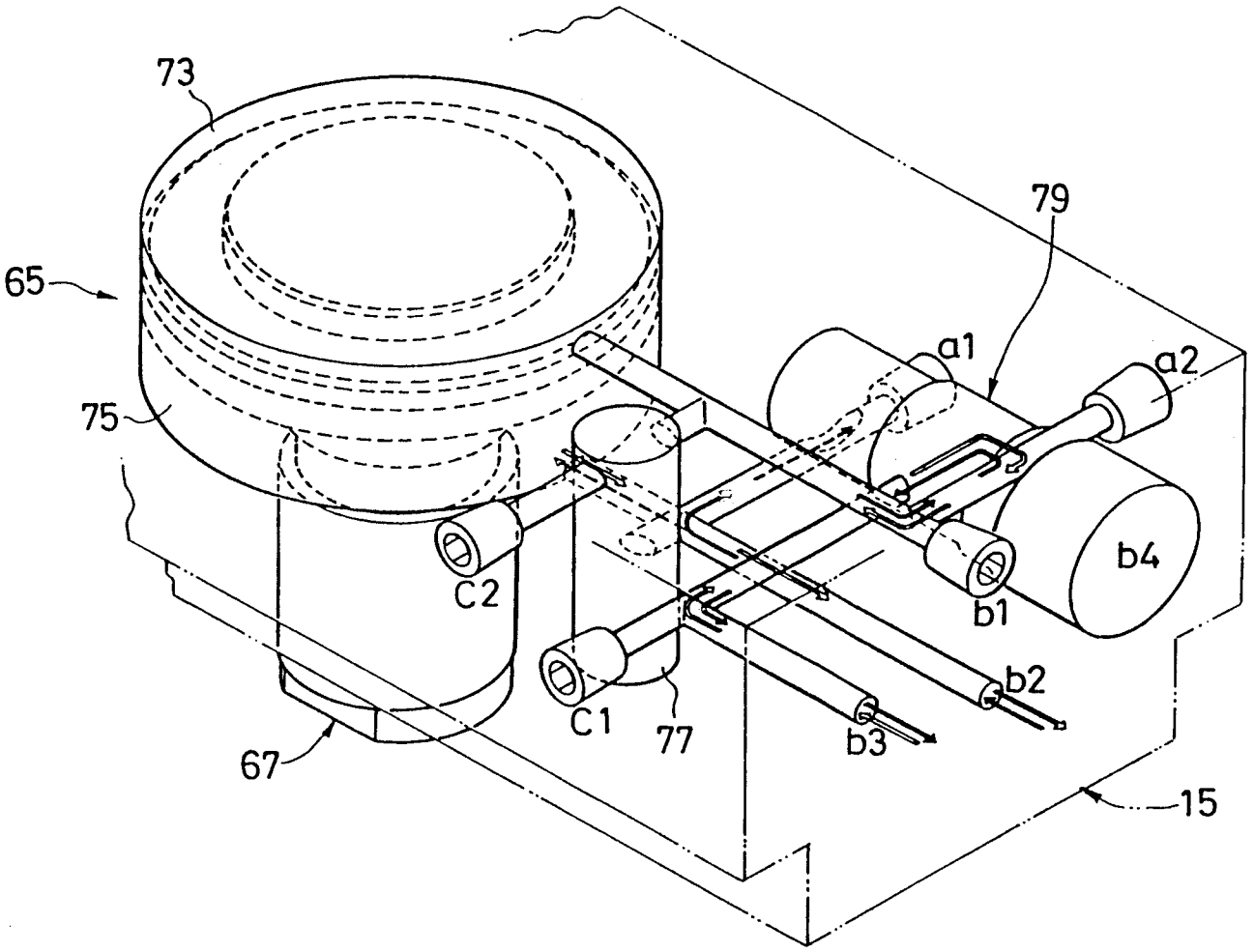
FIG. 8 is a perspective view showing the hydraulic mechanism of a hydraulic cylinder used for striking.

Conversely, in the case where the piston rod 67 is elevated, when operating fluid is fed from the $b_2$ port, as shown by the black arrows in FIG. 8, this operating fluid flows into the lower cylinder chamber 75 and the piston rod 67 is elevated. Because the operating fluid also flows into the tube $a_1$ at the same time, a spool A (FIG. 7) of the switching valve 79 is moved to the right and the valve B (FIG. 7) is opened. As a result, along with the elevation of the piston rod 67, the operating fluid in the upper cylinder chamber 73 is pushed out into the tube $b_1$ by back pressure, flows from the tube $a_2$ through the valve B into the tube $c_1$, passes through the tube $b_3$, and is discharged from the $b_3$ port.

In addition, where the operating fluid is fed to neither the $b_2$ port or the $b_3$ port, when an upward external force (a reaction force which strikes the upper dies 17, 19, during processing) is used on the piston rod 67, the operating fluid in the upper cylinder chamber 73 passes through the tube $b_1$ and flows into the tube $a_2$, then flows no further because the valve B of the switching valve 79 is closed. Accordingly, because the piston rod 67 is not moved vertically, the upper dies 17, 19 can be struck.

Figure 9:
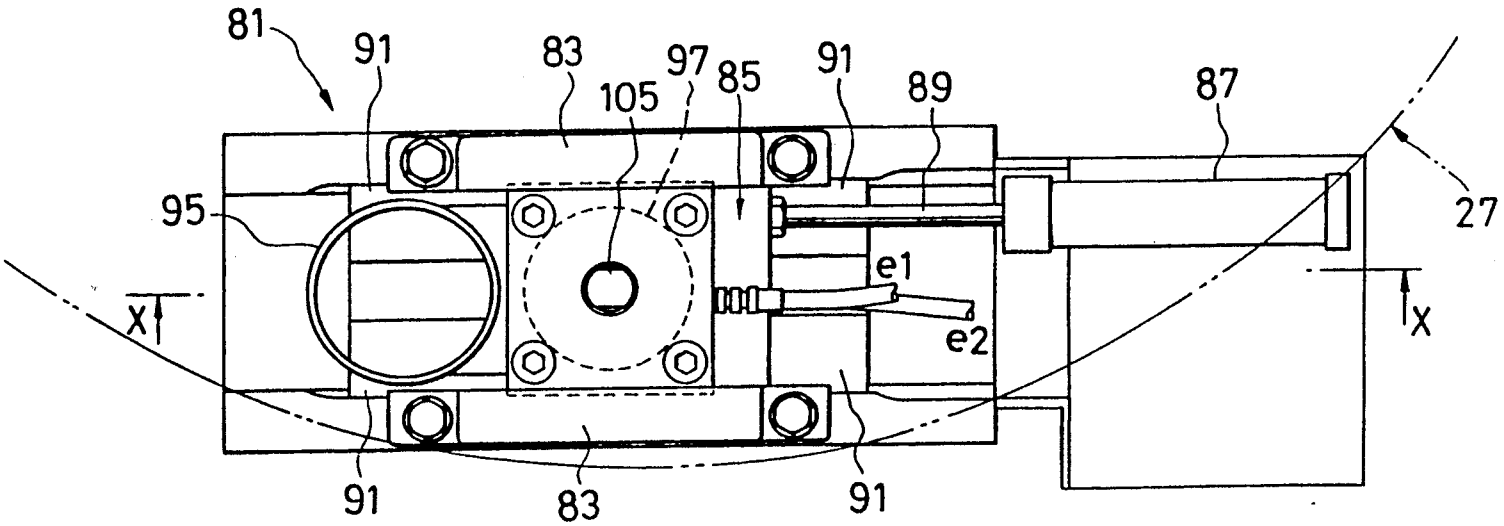
FIG. 9 is a plan view showing a disk support.
Figure 10:
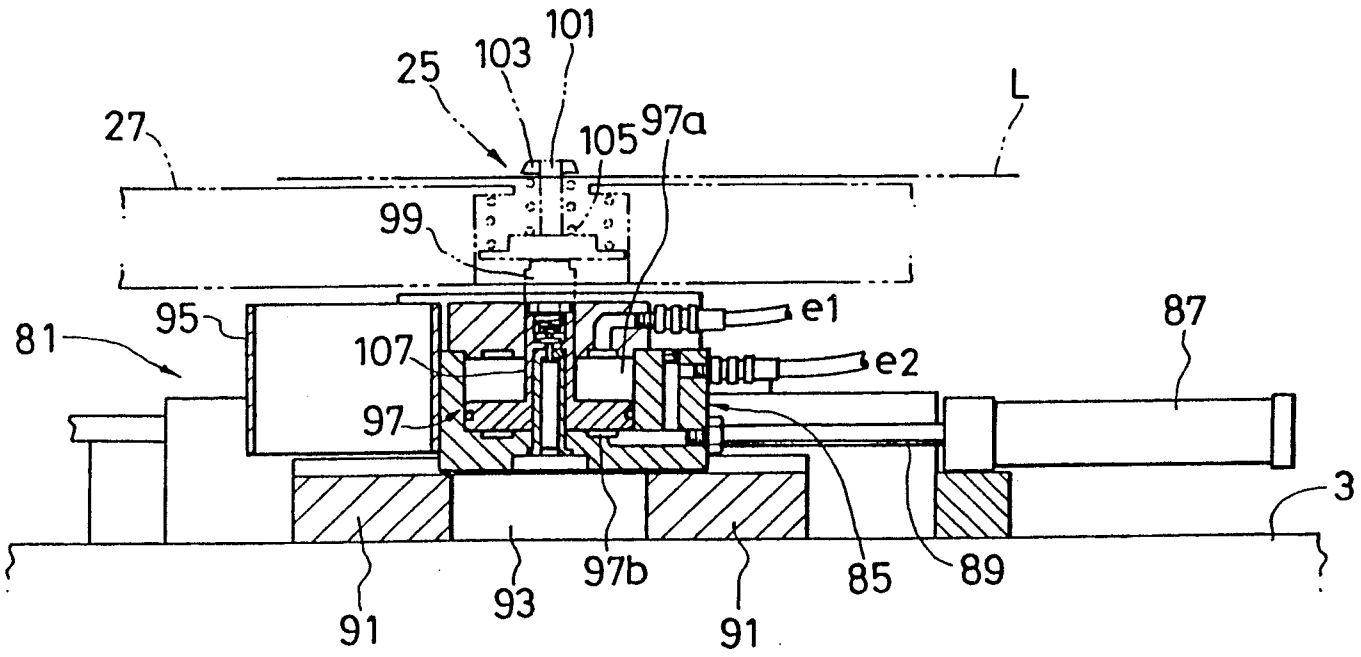
FIG. 10 is a sectional view taken along the line X—X in FIG. 9.

In the processing position, as shown in FIG. 9 and FIG. 10, a disk support 81 is secured to the upper surface of the base 3 of the lower side of the lower turret 27 to protect the lower turret 27 from impact during processing. This disk support 81 has a pair of support members 83 as reinforcing members and a slider 85 which moves horizontally between the support members 83.

The leading end of a piston rod 89 of a shift cylinder 87 is attached to the right end surface of the slider 85 in the drawing. The slider 85 is positioned on the upper surface of a guide 91 provided on the upper surface of the base 3 between the support members 83, by the movement of the piston rod 89. A residue hole 93 through which residue produced by the punching process is discarded is formed at a position corresponding to the processing position at the center portion of the guide 91. A residue disposal guide 95 with a cavity for disposal of residue produced by the punching process is provided on the left half of the slider 85. An embedded fluid cylinder is provided as a forming cylinder 97 for pressing the lower upward-forming die 25 upward.

A die holder 99, a die tip 101 which is integrally provided in the die holder 99, the upper end of which engages the upper upward-forming die 19, and a workpiece ejector 103 which is vertically movable with respect to the die tip 101 are provided on the lower upward-forming die 25. The workpiece ejector 103 is normally energized upward by a spring 105, so that, when the forming process has been completed and the upper upward-forming die 19 ascends, the workpiece W is pressed upward and separated from the die tip 101.

In addition, a piston rod 107 of the forming cylinder 97 is freely projected upward, and, by feeding the operating fluid from a tube $e_1$ to an upper chamber **97*a* of the forming cylinder 97, the piston rod 107 is normally stored so that the upper end of the die tip 101 does not project upward past a pass-line L. The die holder 99 is pressed upward and the upper end of the die tip 101 is projected upward beyond the pass-line L by feeding the operating fluid from a tube $e_2$ to a lower chamber 97*b* of the forming cylinder 97 and pressing the piston rod 107 upward. In this state, the piston rod 13 descends and the upper upward-forming die 19 is struck so that a forming process is performed on the workpiece W. When the piston rod 13 then ascends, the workpiece W which is engaged by the die tip 101 can be ejected from the die tip 101 by the workpiece ejector 103**.

During periods other than the upward-forming process periods, the piston rod 107 is stored inside the forming cylinder 97. Therefore the piston rod 107 does not project upward from the upper surface of the slider 85.

Specifically, the rotary positioning of the lower turret 27 and the movement of the slider 85 are performed while the piston rod 107 is stored inside the forming cylinder 97. There is therefore no obstacle to the movement of the slider 85.

Next, the operations which occur during processing will be explained.

Punching Process

First, as shown in FIG. 11 and FIG. 12, the part of the workpiece W to be processed is positioned at the processing position between the upper turret 21 and the lower turret 27 by controlling the movement in the X-axis direction on the carriage base 35 of the carriage 37 which is provided with the clamp 39 for clamping the workpiece W, and by controlling the movement of the carriage base 35 in the Y-axis direction along the guide rails 29.

The upper turret 21 and the lower turret 27 are rotated in synchronism by a turret servo motor and the specified upper and lower punching dies 17, 23 are positioned at the processing position. As shown in FIG. 1, in the case where one of the upper punching dies 17*a* is to be used from among the dies provided in the radial direction of the upper turret 21, the punching device 15 is positioned on the desired die 17*a* by means of the fixed hydraulic cylinder 51 and the movable hydraulic cylinder 53. The piston rod 67 of the hydraulic striker cylinder 65 which is built into the punching device 15 is projected downward and halted at bottom dead center. The piston rod 89 of the shift cylinder 87 provided in the disk support 81 is drawn back, and the residue disposal guide 95 of the slider 85 is positioned at the processing position.

In this state, the ram 11 is moved vertically by the mechanical type of vertically moving means, and the piston rod 67 of the hydraulic striker cylinder 65 strikes the upper punching dies 17, 17*a* to carry out the punching process. At this time, the punched residue drops downward through the residue disposal guide 95 and the residue hole 93.

Thereafter, the workpiece W is once again positioned, the above-mentioned process is repeated, and the punching operation is performed. However, in the case where the upper turret 21 is to be rotated and the upper punching dies 17, 17*a* changed, the upper turret 21 is rotated by drawing back the piston rod 67 of the hydraulic striker cylinder 65 which is built into the punching device 15.

Upward-Forming Process

In the case where an upward-forming process is performed on the workpiece W, the part of the workpiece W to be processed is positioned at the processing position between the upper turret 21 and the lower turret 27 in the same manner as for the above-described punching process. Then, by controlling the rotation of the upper turret 21 and the lower turret 27 synchronously by the turret servo motor, the desired upper upward-forming die 19 and lower upward-forming die 25 are set at the processing position. At this time, in the same manner as the upper punching die 17*a* shown in FIG. 1, in the case where a plurality of upper upward-forming dies are provided in the radial direction of the upper turret 21, the punching device 15 is positioned directly above the desired die by the fixed hydraulic cylinder 51 and the movable hydraulic cylinder 53.

The piston rod 89 of the shift cylinder 87 provided in the disk support 81 is extended, and the forming cylinder 97 of the slider 85 is positioned in the processing position. Then, when the workpiece W has been positioned and the upper and lower dies 19, 25 have been set, the piston rod 107 of the forming cylinder 97 built into the slider 97 is extended, and the lower upward-forming die 25 is projected upward and set at the specified height.

In this state, the ram 11 is lowered by the crankshaft 10, and when the ram 11 reaches bottom dead center, the piston rod 67 of the hydraulic striker cylinder 65 built into the punching device 15 is extended, and the upper upward-forming die 19 is struck. Specifically, even when the ram 11 housing the piston rod 67 reaches bottom dead center, the upper upward-forming die 19 does not reach bottom dead center, so that the forming process is not yet carried out. Then, when the piston rod 67 is extended until it reaches bottom dead center and the upper upward-forming die 19 is lowered, the forming process begins because the upper upward-forming die 19 has reached bottom dead center.

When the forming process is completed, the piston rod 67 of the hydraulic striker cylinder 65 of the punching device 15 is drawn back, the ram 11 ascends, the piston rod 107 of the forming cylinder 97 is simultaneously drawn back, an the lower upward-forming die 25 returns to the hidden state. In this state, the workpiece W is positioned, and once again forming is carried out by the above-described process.

In this manner, it is unnecessary to operate the hydraulic striker cylinder 65 during the punching process because the piston rod 67 of the hydraulic striker cylinder 65 is secured at bottom dead center. Therefore the frequency of use is reduced and the life span is increased. In addition, during the forming process, the ram 11 is also lowered rapidly by the crankshaft 10, and the upper upward-forming die 19 does not reach bottom dead center. There is therefore no impact against the lower upward-forming die 25 so no breakage or damage occurs. In addition, the height of the upper and lower dies need not be scrupulously, as is required conventionally, therefore operability is improved.

The punching device 15 provided on the lower end of the ram 11 is freely moved and positioned in the radial direction of upper turret 21, therefore, a plurality of upper dies can be mounted in the radial direction on the upper turret 21. For this reason, the number of dies which can be installed is increased and the effectiveness of the operation is improved.

The forming cylinder 97 is built into the right half of the slider 85 of the above-mentioned embodiment and the residue disposal guide 95 is provided on the left half. In addition, the shift cylinder 87 is provided on the right side surface of the slider 85. However, the embodiment is not limited to this positional relationship. Although the hydraulic shift cylinder 87 is used for moving the slider 85, the present invention is not limited to this configuration. An device which can control the position of the slider 85, for example, a drive motor and geared device combination, may be used.

Because the turret punch press of the present invention has a configuration as explained above, and the striker device with a hydraulic cylinder equipped with a vertically movable striker element on the lower end of the ram is provided, the amount of stroke of the striker element with respect to the upper die is the sum of the amount of stroke of the ram and the amount of stroke of the hydraulic cylinder. Accordingly, the upper die contacts the lower die and processing can occur only when the ram and the striker element of the striker device are both at bottom dead center. Accordingly, during the punching process, the striker element of the striker device is normally positioned at bottom dead center, and, if the ram is lowered by the mechanical vertically moving means, the action of the hydraulic cylinder is unnecessary. Therefore the frequency of use is reduced, and the life span is increased. In addition, after the ram is lowered by the mechanical vertically moving means during the forming process, if the striker element of the hydraulic cylinder is lowered and the forming operation is performed, even if the ram is lowered rapidly by the mechanical vertically moving means, the upper die does not reach bottom dead center, therefore there is no impact on the lower die so no breakage or damage occurs. In addition, the adjustment of the height of the upper and lower dies need not be scrupulously performed as is required conventionally so operability is improved. In addition, because the disk support is secured below the lower turret, it is possible to support the lower turret against the striking force in the conventional manner. The movably positioned slider is provided in the disk support, and because the hydraulic cylinder which presses the lower upward-forming die upward and the residue hole through which the residue from the punching operation is dropped are provided, the hydraulic cylinder during the upward-forming process, or the residue hole during the punching process, can be selectively positioned at the process position. As a result, it is possible to handle both the upward-forming process and the punching process. Here, the lower upward-forming die is normally below the pass line so that there is no obstacle when the lower turret rotates or when the workpiece is introduced. Because the hydraulic cylinder projects the lower upward-forming die upward to a position of a specified height during processing, a proper upward-forming process can be performed.

What is claimed is:

1. A turret punch press comprising:

an upper turret on which upper dies are detachably mounted, said upper dies comprising an upper die for punching and an upper die for forming;

a lower turret on which lower dies are detachably mounted, said lower die comprising a lower die for punching and a lower die for forming;

a ram for causing the upper and lower dies to work together at an operation position;

a mechanical type of vertically moving means for moving the ram vertically;

a striker device provided on the lower end of the ram for striking the upper die;

a striking element within the striker device;

a disk support for supporting the lower turret in the processing position; and a freely movable slider provided in the disk support, said slider including, (a) a second hydraulic cylinder for pushing up the lower forming die which is normally positioned below a passline at the operating position, and (b) a residue hole into which the residue from the punching operation drops, selectively positioned in the processing position.

2. A turret punch press for punching and forming, comprising:

an upper turret to which an upper die for punching and an upper die for forming are detachably mounted;

a lower turret on which lower dies for cooperating with the upper punching and forming dies are detachably mounted;

a ram for causing the upper and lower dies to work together at an operating position;

a means for mechanically moving the ram vertically;

a hydraulic cylinder having a piston rod for striking the upper dies, the cylinder being provided on a lower end of the ram, and the piston rod being vertically movable with respect to the ram and positioned at its bottom dead center for punching and at its top dead center initially and then lowered to the bottom dead center when the ram is lowered.

3. The turret punch press of claim 2, wherein the press further comprises a hydraulic cylinder for raising the forming die.

* * * * *

UNITED STATES PATENT AND TRADEMARK OFFICE

CERTIFICATE OF CORRECTION

PATENT NO. : 5,184,498

DATED : February 9, 1993

INVENTOR(S) : Tetsuji Hayashi

It is certified that error appears in the above-indentified patent and that said Letters Patent is hereby corrected as shown below:

IN THE TITLE PAGE:

[73] Assignee should be: --Amada Mfg America Inc.
Amada Company, Ltd.--

Signed and Sealed this

Twentieth Day of December, 1994

*Attest:*

Bruce Lehman

BRUCE LEHMAN

*Attesting Officer*

*Commissioner of Patents and Trademarks*